US006457894B1

(12) United States Patent
Miles

(10) Patent No.: US 6,457,894 B1
(45) Date of Patent: Oct. 1, 2002

(54) KWIK-SNAPP CAP & BRUSH

(75) Inventor: Danny Lee Miles, Herod, IL (US)

(73) Assignee: Danny L. Miles, Herod, IL (US)

( * ) Notice: Subject to any disclaimer, the term of this patent is extended or adjusted under 35 U.S.C. 154(b) by 0 days.

(21) Appl. No.: 09/972,633

(22) Filed: Oct. 9, 2001

(51) Int. Cl.[7] ..... A46B 11/04
(52) U.S. Cl. ..... 401/282; 401/290; 401/289
(58) Field of Search ..... 401/268, 282, 401/289, 290, 183

(56) References Cited

U.S. PATENT DOCUMENTS 5,066,157 A * 11/1991 Liff ..... 401/282
5,547,303 A * 8/1996 Pyrozyk ..... 401/183
5,570,966 A * 11/1996 Phelan ..... 401/183
6,036,389 A * 3/2000 Zima ..... 401/183
6,315,483 B1 * 11/2001 Velliquette ..... 401/183

* cited by examiner

*Primary Examiner*—David J. Walczak

(57) ABSTRACT

This product is a specially designed squeeze bottle cap with an attachment sauce brush that snaps into place in the cap. The cap is designed with an o-ring type of seal that allows the brush to snap in place with its groove at the end of the tube. This cap and brush system eliminates almost all waste when in use by applying the sauce directly to the meat or other intended use. It also eliminates the use of both hands when cooking, for example, brush in one hand and bowl of sauce in the other. When the brush is not in use the cap aides the application of the sauce to your favorite snacks. Clean up is also easy by just pulling out the brush and rinsing it off or throw it in the dishwasher. This cap and brush system is both a waste eliminator and a time saver.

3 Claims, 1 Drawing Sheet

KWIK-SNAPP CAP & BRUSH

SUMMARY OF THE INVENTION

To facilitate one's comprehension and understanding of a new product, that idea must be described not only as it exists as an answer to a subsistent problem, but also as it functions physically. Incorporated into this overview is a description of the invention's physical appearance.

Based upon the Inventor's description and our outside research, we will describe the basic overall features, shape and design of Kwik Snapp Cap & Brush. Materials of which the invention would be produced will also be described.

The design of Kwik Snapp Cap & Brush calls for a durable plastic material to be used as its major component. The plastic would most likely be produced under a process called molding. Molding involves melting a solid resin into a syrupy liquid form and then inserting it into the desired mold. The resin is then subjected to high levels of pressure and high temperatures. It is then allowed to cool and harden before removal from the mold in order to maintain its newly formed shape.

The plastic material would be used to create a modified version of the traditional flip cape commonly used on ketchup bottles. The cap, measuring one and one-quarter inches in diameter, would be produced in the traditional manner with one exception. The opening of the cap would be equipped with slightly raised edges. These edges would accommodate a hollow plastic tube with a beveled end, allowing the tube to be securely snapped onto the opening. The tube would extend upward forming a rectangular shaped brush. The head of the brush would be covered with long bristles, produced from a nylon or plastic material. The center of the brush's base would be equipped with a small opening directly linked to the hollow portion of the tube.

The tube and brush attachment would be approximately four and one-half inches in length and have a brush width of two inches.

To use Kwik Snapp Cap & Brush, one would simply apply the tube to the cap's opening, the cap being applied to a standard bottle of barbecue sauce. The individual would then turn the bottle in an inverted position and apply pressure to its body, forcing the sauce out of the cap's opening. The sauce would then travel through the hollow tube and onto the set of bristles. The individual would then be able to easily spread the sauce onto the desired food item in a controlled and neat manner. Kwik Snapp Cap & Brush would be easy to rinse clean after each use.

In order to fully appreciate the benefits and need of an innovation, one should consider any possible modifications that would arise from the use of the idea.

PTI, therefore, shall suggest other applications of Kwik Snapp Cap & Brush that would merit future consideration and study. The scope of this review may include the use of materials other than those specified by the Inventor. In addition, this review may support the use of additional materials, color schemes, diversified applications, broader consumer outlets or other possible shape and design alterations that may enhance the utility and salability of the invention. All in all, we shall attempt to identify any variations that would further define the scope of the idea One must remember, however, that these modification suggestions are limited within the latitude of the invention. Some inventions lend themselves easily to future applications, i.e., different shapes, materials, color schemes, etc. Other inventions, however, are geared to a specific group of consumers, to one particular design or to a strict manufacturing process. As a result, any suggested modifications to the invention may be limited within the invention's scope.

The following modifications are suggested to augment the usefulness and popularity of Kwik Snapp Cap & Brush. It should be noted that these and or other suggested modifications or variations of your invention will not be included in your preliminary patent art.

Kwik Snapp Cap & Brush could be produced in a variety of sizes, such as small, medium, and large, allowing the consumer to choose the size of applicator to best accommodate his needs.

Kwik Snapp Cap & Brush could be produced in a variety of colors, allowing the product to be more aesthetically appealing. The tube itself could be clear, allowing consumers to watch the sauce as it passes through in order to ensure a thorough cleaning.

In addition, detailed diagrams and technical specifications remain to be created. Nonetheless, there is a clear idea of the Inventor's intent and goals in submitting this design.

DESCRIPTION OF THE PREFERRED EMBODIMENT

Figure 2:
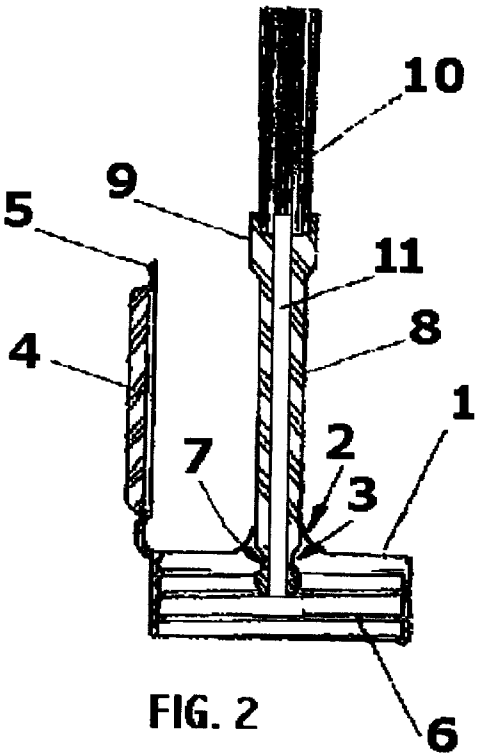
FIG. 2 is a side cross-sectional view of the coupling of the invented devices.
Figure 1:
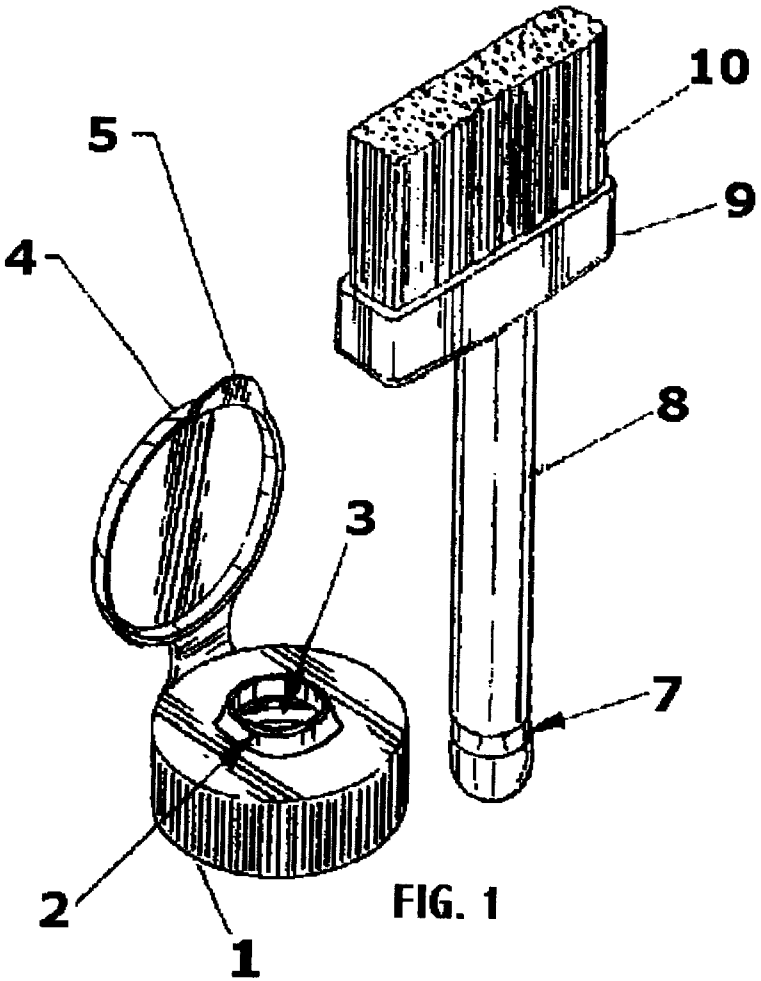
FIG. 1 is a perspective view of the invented devices.

Referring now to FIG. 1 and FIG. 2 as a sauce or condiment dispensing device that can be used seperately or in conjunction with one another. The device is comprised of two major components. A cap 1 and an applicator brush 8. The cap 1 is comprised of a flat top with a conical pour spout 2. The cap has a hinged lid 4 with a easily accessible lift tab 5 to aid in the ease of opening the hinged lid 4 . The interior of the cap 1 consists of standard conventional condiment bottle threads 6. The threads 6 of the cap 1 are for threadedly coupling the cap and brush device to a standard threaded neck portion of any such conventional sauce bottle. The top of the cap 1 is comprised of a layer of plastic thick enough to accommodate a positive O-ring type seal 3 directly below the pour spout 2, as well as providing added stability to brush 8 once it has been coupled to the cap 1 . The positive O-ring seal 3 is directly proportionate to the snap-groove 7 on the end of the applicator brush 8. The snap-in groove 7 is located at the bottom end of the cylindrical tube of the brush attachment 8. The end of the tube is slightly beveled to allow easy access into the cap 1 through the pour spout 2.

The brush 8 is comprised of a hollow four and a half inch cylindrical tube and brush head 9 consisting of many plastic brush bristles 10. The brush head 9 and cylindrical tube are all one unit with a hollow center 11 for which to allow access of a standard fluid or condiment from bottle to brush bristles 10 for easy application of sauce or condiment to all cooking needs. While the brush 8 is not in use, the cap 1 can still be used to dispense condiment directly from bottle to food, sandwich, etc. The brush head 9 can be used for placement of the manufacturers name or logo.

The design of the KWIK-SNAPP CAP AND BRUSH calls for the use of durable plastic as its main component of construction. It's construction would be done by a molding process in which a syrupy liquid plastic would be poured into molds of the specially designed cap 1 and applicator brush 8. The plastic resin would be subjected to high temperatures and pressures that would result in a long and durable product. The product would then be allowed to cool and harden before removal from the mold in order to maintain its newly formed shape.

The various components of the above invented devices are constructed primarily of plastic. However, as will a person skilled in the art, the size, shape, and materials of construction, the various components may be varied without departing from the essence of the present invented device.

What is claimed is:

1. A combination cap and brush device comprising:

a cap having a lid hingedly attached thereto and a conical pour spout positioned on a top wall thereof wherein said cap is adapted to be threaded onto a threaded neck of a conventional condiment or sauce bottle;

an O-ring seal disposed below said conical pour spout; and a brush member comprised of a hollow tube and a brush head having a plurality of bristles thereon, said hollow tube connected at one end to said brush head and having a snap-in groove positioned at the opposite end, wherein said snap-in groove engages said O-ring seal to thereby fluidly connect said hollow tube with said pour spout to thereby enable product within the bottle to flow from the bottle, through said conical spout, through said hollow tube and into said brush head so as to enable a user to spread the product with said bristles and when the device is not in use, said hollow tube can be removed from said conical spout and said lid can close said conical spout.

2. The combination cap and brush device as defined in claim 1 and further comprising a lift tab positioned on the cap.

3. The combination cap and brush device as defined in claim 1 wherein said cap is comprised of plastic.

* * * * *